US009593446B2

(12) United States Patent
Nater

(10) Patent No.: US 9,593,446 B2
(45) Date of Patent: Mar. 14, 2017

(54) METHOD OF PRODUCING WIRE ROPE

(71) Applicant: Fatzer AG Drahtseilfabrik, Romanshorn (CH)

(72) Inventor: Christof Nater, Kesswil (CH)

(73) Assignee: Fatzer AG Drahtseilfabrik, Romanshorn (CH)

( * ) Notice: Subject to any disclaimer, the term of this patent is extended or adjusted under 35 U.S.C. 154(b) by 241 days.

(21) Appl. No.: 14/315,630

(22) Filed: Jun. 26, 2014

(65) Prior Publication Data

US 2015/0000242 A1 Jan. 1, 2015

(30) Foreign Application Priority Data

Jun. 28, 2013 (CH) ..... 1193/13

(51) Int. Cl.

*D07B 1/06* (2006.01)
*D07B 7/02* (2006.01)
*D07B 5/00* (2006.01)

(52) U.S. Cl.

CPC ..... *D07B 1/0686* (2013.01); *D07B 5/00* (2013.01); *D07B 7/02* (2013.01); *D07B 2201/102* (2013.01); *D07B 2201/1032* (2013.01); *D07B 2201/2047* (2013.01); *D07B 2201/2048* (2013.01); *D07B 2201/2053* (2013.01)

(58) Field of Classification Search

CPC ..... D07B 1/0686; D07B 5/00
See application file for complete search history.

(56) References Cited

U.S. PATENT DOCUMENTS

| | | | | |
|---|---|---|---|---|
| 986,817 A | | 3/1911 | Gore | |
| 1,003,597 A | | 9/1911 | Gore | |
| 1,076,759 A | | 10/1913 | Gore | |
| 1,183,487 A | | 5/1916 | Parker | |
| 2,136,865 A | * | 11/1938 | Reed | D07B 1/0686 57/220 |

(Continued)

FOREIGN PATENT DOCUMENTS

| | | |
|---|---|---|
| DE | 451015 C | 10/1927 |
| DE | 711238 C | 9/1941 |

(Continued)

OTHER PUBLICATIONS

Abstract of EP 2708642.
European search report for EP 14 16 7365 dated Feb. 2, 2015.

*Primary Examiner* — Shaun R Hurley
(74) *Attorney, Agent, or Firm* — Brian Roffe

(57) ABSTRACT

With a wire rope comprising at least one plastic core (11) and a number of wire strands (15) twisted around the latter a helical groove (20) is respectively produced by machining around the periphery of the plastic core (11) for each wire strand (15). The cross section of these helical grooves (20) is respectively matched to the outside diameter of the wire strands (15). The plastic core (11) is provided with the helical grooves (20) for receiving the wire strands (15) by this machining directly before the wire strands (15) are wound onto said core. By thus forming the wire rope by means of this machining in order to produce helical grooves of the plastic core, optimal guiding of the wire strands in the twisted state is achieved, and so overall there are improvements to the properties of the wire rope.

19 Claims, 2 Drawing Sheets

(56) References Cited

U.S. PATENT DOCUMENTS

| | | | | | |
|---|---|---|---|---|---|
| 2,136,867 | A * | 11/1938 | Reed | D07B 1/0686 | 57/220 |
| 3,686,855 | A | 8/1972 | Falcy et al. | | |
| 4,509,319 | A * | 4/1985 | Yoshida | D07B 1/0686 | 57/213 |
| 4,530,205 | A | 7/1985 | Seiler et al. | | |
| 4,680,923 | A * | 7/1987 | Kaempen | B29C 53/564 | 52/309.16 |
| 5,207,302 | A | 5/1993 | Popp et al. | | |
| 5,269,128 | A * | 12/1993 | Walton | D07B 1/0686 | 57/210 |
| 5,321,922 | A | 6/1994 | Popp et al. | | |
| 5,487,261 | A * | 1/1996 | Varga | G02B 6/4491 | 57/11 |
| 5,669,214 | A | 9/1997 | Kopanakis | | |
| 5,797,254 | A * | 8/1998 | Walton | D07B 1/0686 | 57/216 |
| 5,911,677 | A * | 6/1999 | Kupelian | B21L 11/005 | 59/35.1 |
| 6,360,522 | B1 | 3/2002 | Walton | | |
| 7,064,276 | B2 * | 6/2006 | Sakabe | G02B 6/4461 | 174/110 R |
| 7,401,961 | B2 | 7/2008 | Longatti et al. | | |
| 7,600,366 | B2 * | 10/2009 | Furukawa | D07B 1/0673 | 57/212 |
| 8,418,433 | B2 * | 4/2013 | Noguchi | B66B 7/06 | 57/237 |
| 2013/0047572 | A1 * | 2/2013 | Morgan | B21D 39/04 | 57/200 |
| 2013/0227926 | A1 * | 9/2013 | Amils | D07B 1/068 | 57/218 |
| 2013/0318937 | A1 * | 12/2013 | Takeuchi | D07B 1/0686 | 57/220 |

FOREIGN PATENT DOCUMENTS

| | | | |
|---|---|---|---|
| DE | 837797 | C | 5/1952 |
| DE | 1071543 | B | 12/1959 |
| EP | 1040221 | B1 | 7/2002 |
| EP | 2708642 | A2 | 3/2014 |
| GB | 27736 | | 0/1911 |
| GB | 2254086 | A | 9/1992 |
| GB | 2269400 | A | 2/1994 |

* cited by examiner

METHOD OF PRODUCING WIRE ROPE

FIELD OF THE INVENTION

The invention relates to a wire rope including at least one plastic core and a number of wire strands twisted around the plastic core(s) and to a production method for producing such a wire rope wherein a number of wire strands are twisted around a plastic core moved with a feed motion in the axial direction, the wire strands thereby being wound around the plastic core with a specific revolution speed and feed speed.

BACKGROUND OF THE INVENTION

With a wire rope according to publication EP-A-1 040 221 a cylindrically formed core is provided with a number of wire strands twisted around the latter. Moreover, disposed between each adjacent pair of strands are filler elements which are made of a polymeric or elastomeric material and have an oriented molecular structure. Assigned respectively to these filler elements is an enlarged foot portion which fills the space formed between two strands and the core, and so can lie over the central core.

With this cylindrically formed core, during operation of the wire rope a flow outwards in the radial direction generally forms after a certain initial operating time, due to which grooves matched to the outer contours of the wire strands are produced around the periphery of the core. However, different disadvantages are associated with this, and in particular creep and so an extension of the whole wire rope occurs during operation which must be compensated again. Moreover, the rope diameter also changes during operation, and this must be taken into consideration when installing the latter.

OBJECTS AND SUMMARY OF THE INVENTION

It is the object of the present invention to devise a wire rope by means of which the properties of the wire rope are improved, in particular in relation to smooth operation and internal cohesion.

According to the invention, this object is achieved by a wire rope including a helical groove that is respectively produced by machining around the periphery of a plastic core for each wire strand, the cross section of these helical grooves respectively being matched to the outside diameter of the wire strands, and by a method of producing such a wire rope wherein the plastic core is provided with helical grooves for receiving the wire strands by machining directly before the wire strands are wound onto the core.

By means of this wire rope design with this machining in order to produce helical grooves of the plastic core, optimal guiding of the wire strands in the twisted state is achieved and so overall, different improvements to the properties of the wire rope are achieved.

With the method according to the invention of machining such as to produce the helical grooves directly before the wire strands are twisted around the plastic core one gains the advantage that these helical grooves are provided with absolutely the same length of lay as the stranded rope.

BRIEF DESCRIPTION OF THE DRAWINGS

Exemplary embodiments and further advantages of the invention are described in more detail below by means of drawings. These show as follows.

DETAILED DESCRIPTION OF THE INVENTION

Figure 1:
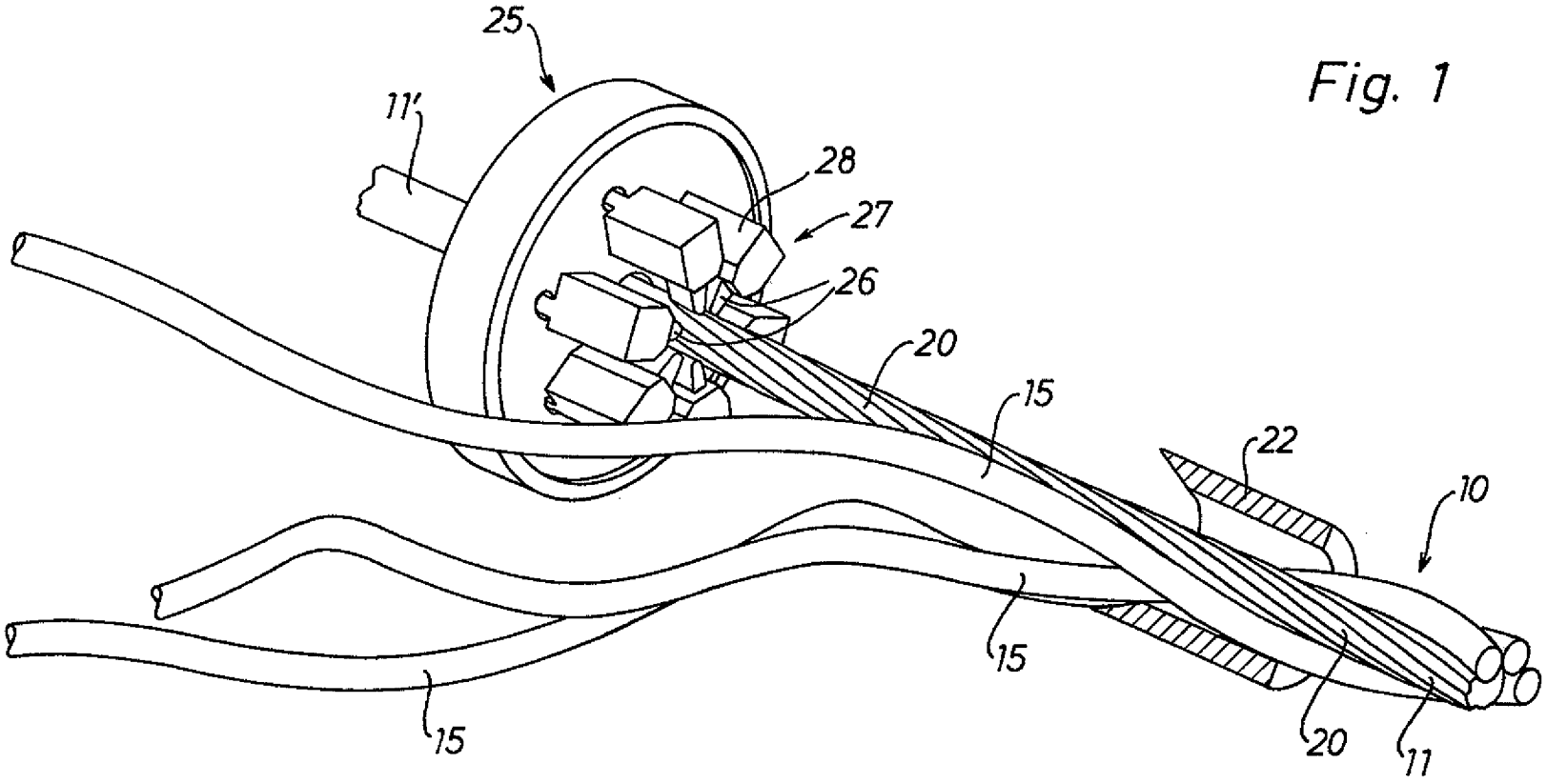
FIG. 1 is a diagrammatic illustration of the production of a wire rope according to the invention, of which part of the length of the plastic core and of three of the wire strands are respectively illustrated.

FIG. 1 shows the production of a wire rope 10 with a plastic core 11 and a number of wire strands 15 twisted around the latter, for better illustration only three of the total of six wire strands being shown. The plastic core 11 is produced here from one or more flexible plastics, and it could, moreover, be provided with fibre reinforcement.

Such wire ropes are suitable for all types of cable car, for example for use with railway vehicles which are pulled by wire cables which are guided between the rails on rollers or the like.

According to the invention a helical groove 20 is respectively produced by machining around the periphery of the plastic core 11 for each wire strand 15, these helical grooves 20 respectively being matched to the outside diameter of the wire strands 15.

The wire strands 15 are twisted around this plastic core 11 moved with a feed motion in the axial direction, said wire strands being wound around the plastic core 11 with a specific revolution speed and feed speed. The plastic core 11 is provided with these helical grooves 20 by machining directly before the wire strands 15 are wound onto said core.

This machining according to the invention of the plastic core 11 introduced as a cylindrical bar 11' made of a flexible plastic is implemented by means of a machining device 25 in which cutting tools 26 are rotated around the plastic core 11 with the same revolution speed as the wire strands 15 in order to produce the helical grooves. The cutting tools 26 are directed here with their blades opposing the direction of movement of the plastic core. There is assigned to each cutting tool 26 a tool holder 27 which is respectively fastened with radial adjustment to a rotatable tool head 25 with a central opening for passing through the bar 11'. The respective tool holder 27 consists of a clamping chuck 28 and an adjustment module (not detailed) by means of which the cutting tool 26 can be set precisely to the diameter of the plastic core 11. The rotary drive of the tool head 25 and the reels with the wire strands 15 wound over them are not detailed.

The wire strands 15 and the plastic core 11 are drawn through an annular mandrel 22 in the axial direction with the same feed speed. The wire strands 15 are advantageously pre-formed in a helical shape when introduced for twisting and are drawn together with the plastic core, the wire strands being pressed against the plastic core by this mandrel 22, these grooves 20 thereby serving as a guide for the wire strands 15.

Figure 2:
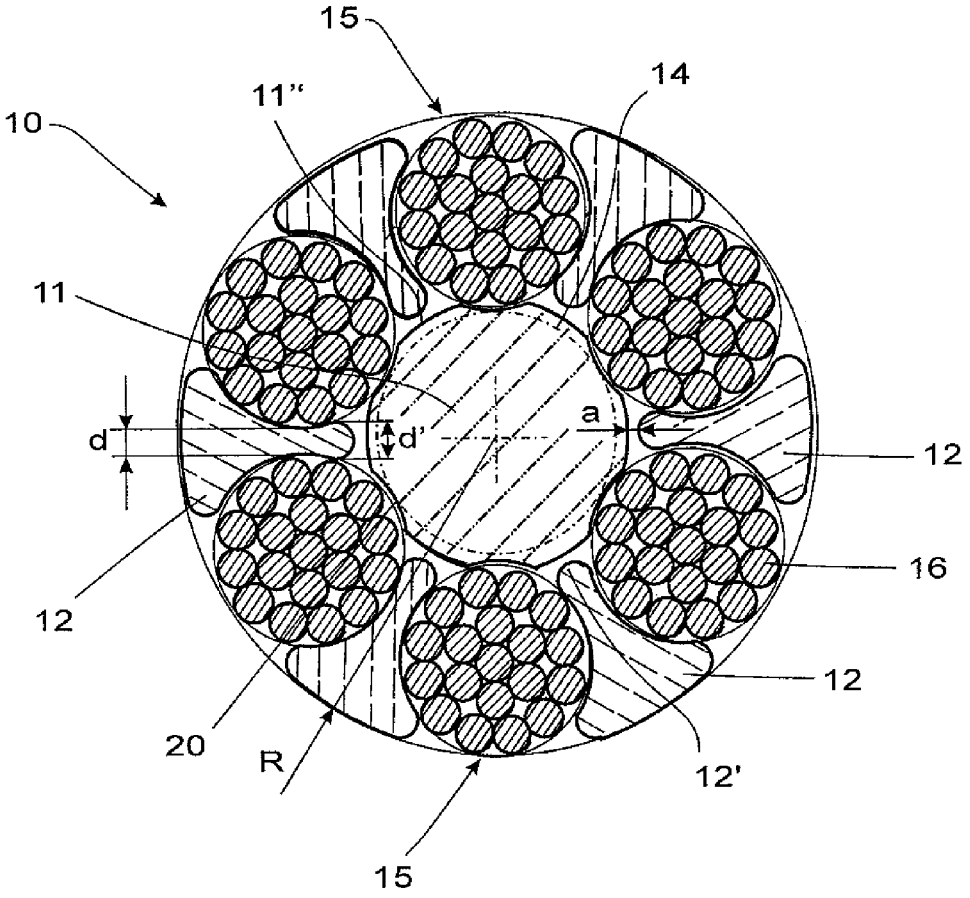
FIG. 2 is a cross section of a wire rope according to the invention.

FIG. 2 shows a wire rope 10 with a number of wire strands 15 produced from twisted wires 16 which are twisted around a plastic core 11 and elongate inserts 12 are arranged between said strands. The cross sections of these inserts 12 extending over the whole length of the rope are shaped such that they extend almost to the outer circumference of the wire rope 10. They are provided here on the outer circumference with a radius R corresponding to approximately half the diameter of the rope so as to form an almost equal outside diameter together with the wire strands 15. In the region in contact with the wire strands 15 they respectively have on both sides a radius corresponding to the wire strands 15.

These wire ropes 10 are used in particular as pulling or hoisting cables with high loading requirements, for example in cable cars which are guided suspended on a stationary supporting cable and are connected to a pulling cable. Pulling or hoisting cables are generally guided around rollers at the upper and lower stations and are made as endless ropes by means of so-called splicing of their ends or are held together by an end attachment (not detailed).

The twisted wire strands 15 lie directly over the plastic core 11 over a specific peripheral region in the grooves 20, the inserts 12, however, respectively being arranged on the inside a distance a away from an outer circumferential surface 11" of the plastic core 11.

When using a total of six wire strands, this groove 20 with a respective wire strand 15, with which it lies directly over the plastic core 11, corresponds to an angular range of a respective wire strand in relation to its cross section of preferably between 40° and 60°. These helical grooves 20 have a round cross section with a radius which corresponds approximately to half the diameter of a wire strand 15.

The distances a between the inserts 12 and the plastic core 11 respectively have dimensions such that they respectively correspond at least approximately to an extension which occurs due to the outwardly directed flow of the plastic core 11 in the radial direction after a certain initial operating time of the wire rope. This extension moves over a range of millimeters depending on the diameter of the core and the loading of the wire rope.

The inserts 12 with their inside end part 12' respectively projecting through two wire strands 15 respectively have a thickness d' which is greater than the thickness d in the narrowest region of the respective insert 12, these inside end parts 12' ending outside of a notional circle 14 on the insides of the wire strands 15, as shown by dots and dashes. This inside end part 12' of the inserts 12 is respectively rounded, but could also be elliptical, or in the shape of a half polygon or even flat.

The invention is sufficiently displayed by the exemplary embodiments described. Needless to say, it could also be illustrated by other variations in which, for example, a number of wire strands other than six could be used.

The invention claimed is:

1. A method of producing a wire rope, comprising:

moving a plastic core with a feed motion in an axial direction of the plastic core;

providing the plastic core with helical grooves during the movement of the plastic core in the axial direction; and then winding each of a number of wire strands into a respective one of the helical grooves around the plastic core while the plastic core is moving in the axial direction and the plastic core is being provided with helical grooves, whereby the wire strands are thus twisted around the plastic core.

2. The method according to claim 1, wherein the step of winding each of a number of wire strands into a respective one of the helical grooves around the plastic core comprises rotating the wire strands around the plastic core at a rotation speed, and the step of providing the plastic core with helical grooves during the movement of the plastic core in the axial direction comprises rotating a plurality of cutting tools corresponding in number to a number of helical grooves being provided to the plastic core around the plastic core with a rotation speed that is the same as the rotation speed of the wire strands around the plastic core.

3. The method according to claim 1, further comprising coordinating the movement of the plastic core in the axial direction and the winding of the wire strands into the helical grooves such that the plastic core and wire strands move in the axial direction at the same feed speed.

4. The method according to claim 1, further comprising:

forming each of the wire strands in a helical shape prior to winding each of the wire strands into a respective one of the helical grooves around the plastic core; and drawing the wire strands together with the plastic core by means of an annular mandrel to cause the wire strands to be pressed against the plastic core by the annular mandrel.

5. A machining device for implementing the process for producing a wire rope according to claim 1, comprising a rotatable tool head with a central opening through which the plastic core passes, and radially adjustable cutting tools for producing the helical grooves in the plastic core after the plastic core passes through the central opening of the tool head.

6. The machining device according to claim 5, further comprising a clamping tool holder coupled to each cutting tool and which is radially adjustable to enable the radial adjustment of the cutting tools, the clamping tool holders being fastened to the tool head.

7. The method according to claim 1, wherein the step of moving the plastic core with the feed motion in the axial direction of the plastic core comprises drawing the plastic core in the axial direction and the step of winding each of the wire strands into a respective one of the helical grooves around the plastic core while the plastic core is moving in the axial direction comprises drawing the wire strands in the axial direction at the same time, further comprising:

coordinating the drawing of the plastic core and wire strands in the axial direction such that the plastic core and wire strands move in the axial direction at the same feed speed.

8. The method according to claim 1, wherein the step of providing the plastic core with helical grooves during the movement of the plastic core in the axial direction comprises machining the helical grooves directly into the plastic core.

9. The method according to claim 1, wherein the step of providing the plastic core with helical grooves during the movement of the plastic core in the axial direction comprises matching a cross section of the helical grooves to an outside diameter of the wire strands.

10. The method according to claim 1, wherein the wire strands have the same diameter and the step of providing the plastic core with helical grooves during the movement of the plastic core in the axial direction comprises forming the helical grooves with a round cross-section with a radius which corresponds approximately to half of the diameter of the wire strand.

11. The method according to claim 1, wherein the plastic core has a form of a bar and comprises at least one flexible plastic with optional fiber reinforcement.

12. The method according to claim 1, further comprising, when using six wire strands, guiding the wire strands within the helical grooves in an angular range of a respective wire strand of 40° to 60° in relation to the cross section.

13. The method according to claim 1, further comprising placing an elongate insert between adjacent ones of the wire strands, each insert being configured to extend almost to an outer circumference of the wire rope and, on the inside, being configured to extend to a distance (a) away from an outer circumferential surface of the plastic core.

14. The method according to claim 13, wherein each of the inserts has an inside end part projecting through two adjacent one of the wire strands that has a thickness (d') which is greater than a thickness (d) in a narrowest region of the insert, the inside end part ending outside of a notional circle on insides of the wire strands.

15. The method according to claim 13, wherein each of the inserts has an outer circumference with radius (R) corresponding to almost half a diameter of the wire rope in order to form an almost equal outside circumference with the wire strands.

16. The method according to claim 1, wherein the plastic core is provided with the helical grooves directly before the wire strands are wound into the helical grooves around the plastic core.

17. The method according to claim 16, wherein the step of providing the plastic core with helical grooves during the movement of the plastic core in the axial direction comprises machining the helical grooves directly into the plastic core.

18. The method according to claim 1, further comprising coordinating the providing of the plastic core with helical grooves and the winding of the wire strands into the helical grooves such that the plastic core is provided with the helical grooves at the same time as and directly before the wire strands are wound into the helical grooves around the plastic core.

19. The method according to claim 1, wherein the step of providing the plastic core with helical grooves during the movement of the plastic core in the axial direction comprises rotating a plurality of cutting tools corresponding in number to a number of helical grooves being provided to the plastic core around the plastic core.

* * * * *